US011584142B2

(12) United States Patent
Murashima et al.

(10) Patent No.: US 11,584,142 B2
(45) Date of Patent: Feb. 21, 2023

(54) DRYING APPARATUS AND IMAGE FORMING SYSTEM

(71) Applicant: KYOCERA Document Solutions Inc., Osaka (JP)

(72) Inventors: Masaki Murashima, Osaka (JP); Tomoya Hotani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/674,097

(22) Filed: Feb. 17, 2022

(65) Prior Publication Data

US 2022/0281236 A1 Sep. 8, 2022

(30) Foreign Application Priority Data

Mar. 3, 2021 (JP) ..... JP2021-033614

(51) Int. Cl.
*B41J 11/00* (2006.01)

(52) U.S. Cl.
CPC ..... *B41J 11/0022* (2021.01)

(58) Field of Classification Search
CPC .. B41J 11/0022; B41J 11/00216; B41J 11/007
See application file for complete search history.

(56) References Cited

U.S. PATENT DOCUMENTS

2001/0015746 A1* 8/2001 Yosimura ..... F26B 25/004 347/102

FOREIGN PATENT DOCUMENTS

JP 2017-140774 8/2017

* cited by examiner

*Primary Examiner* — Bradley W Thies
(74) *Attorney, Agent, or Firm* — Lex IP Meister, PLLC

(57) ABSTRACT

The drying apparatus includes a conveying belt and a heating unit. The heating unit includes a blower fan, a rectifying member, a heater, and a reflecting plate. The rectifying member is arranged on the downstream side of the blower fan in the blowing direction of the blower fan and includes one or more first through holes. The heater is arranged on the downstream side of the rectifying member in the blowing direction to radiate infrared rays in all directions. The reflecting plate is arranged between the rectifying member and the heater, includes one or more second through holes, and reflects the infrared rays radiated from the heater to the side of the conveying belt. The one or more first through holes are formed in a portion other than a portion where the infrared rays passing through the one or more second through holes of the reflecting plate are radiated.

2 Claims, 7 Drawing Sheets

DRYING APPARATUS AND IMAGE FORMING SYSTEM

INCORPORATION BY REFERENCE

This application is based upon and claims the benefit of priority from the corresponding Japanese Patent Application No. 2021-033614 filed on Mar. 3, 2021, the entire contents of which are incorporated herein by reference.

BACKGROUND

The present disclosure relates to a drying apparatus for drying a recording medium having an image formed thereon while conveying the recording medium, and an image forming system including the drying apparatus.

An image forming system including an inkjet type image forming apparatus is provided with a drying apparatus for drying an image formed on a recording medium such as paper. In a typical drying apparatus, a fan is provided on the back surface of the casing, and air taken in by the fan is blown from the side of the recording medium conveyed by the conveying unit.

However, when the air is blown from the side of the recording medium as in the case of the typical drying apparatus, the recording medium tends to float, and there is a possibility that a conveyance failure of the recording medium occurs.

An infrared heater may also be used in another typical drying apparatus. In order to efficiently dry the ink, it is effective to evaporate the moisture of the ink by blowing the air from the fan in addition to the infrared rays. Further, it is preferable to blow the air from above the recording medium to prevent the recording medium from floating when the recording medium is conveyed. Considering the above-description, the heater must be located downstream of the fan in the blowing direction of the fan.

When the infrared heater is arranged in this way, the infrared rays are also radiated from the infrared heater to the fan. Then, the parts of the fan may be heated and damaged.

SUMMARY

A drying apparatus of the present disclosure for drying a medium on which the image is formed while conveying the medium includes a conveying belt and a heating unit. The conveying belt supports the medium and conveys it in a predetermined conveying direction. The heating unit dries the image by blowing hot air on the medium. The heating unit includes a blower fan, a rectifying member, a heater, and a reflecting plate. The blower fan takes in outside air and blows air toward the conveying belt. The rectifying member is arranged on the downstream side of the blower fan in the blowing direction of the blower fan and includes one or more first through holes. The heater is arranged on the downstream side of the rectifying member in the blowing direction to radiate infrared rays in all directions. The reflecting plate is arranged between the rectifying member and the heater, includes one or more second through holes, and reflects infrared rays radiated from the heater to the side of the conveying belt. The one or more first through holes in the rectifying member are formed in a portion other than a portion where the infrared rays passing through the one or more second through holes of the reflecting plate are radiated among the infrared rays radiated from the heater.

An image forming system of the present disclosure includes an image forming apparatus for forming an image on a medium, and a drying apparatus for drying the medium on which the image is formed by the image forming apparatus while conveying the medium. The drying apparatus includes a conveying belt and a heating unit. The conveying belt supports the medium and conveys it in a predetermined conveying direction. The heating unit dries the image by blowing hot air on the medium. The heating unit includes a blower fan, a rectifying member, a heater, and a reflecting plate. The blower fan takes in outside air and blows air toward the conveying belt. The rectifying member is arranged on the downstream side of the blower fan in the blowing direction of the blower fan and includes one or more first through holes. The heater is arranged on the downstream side of the rectifying member in the blowing direction to radiate infrared rays in all directions. The reflecting plate is arranged between the rectifying member and the heater and includes one or more second through holes for reflecting the infrared rays radiated from the heater to the side of the conveying belt. The one or more first through holes in the rectifying member are formed in a portion other than a portion where the infrared rays passing through the one or more second through holes of the reflecting plate are radiated among the infrared rays radiated from the heater.

DETAILED DESCRIPTION

An image forming system and a drying apparatus according to an embodiment of the present disclosure will be described below with reference to the figures.

Figure 1:
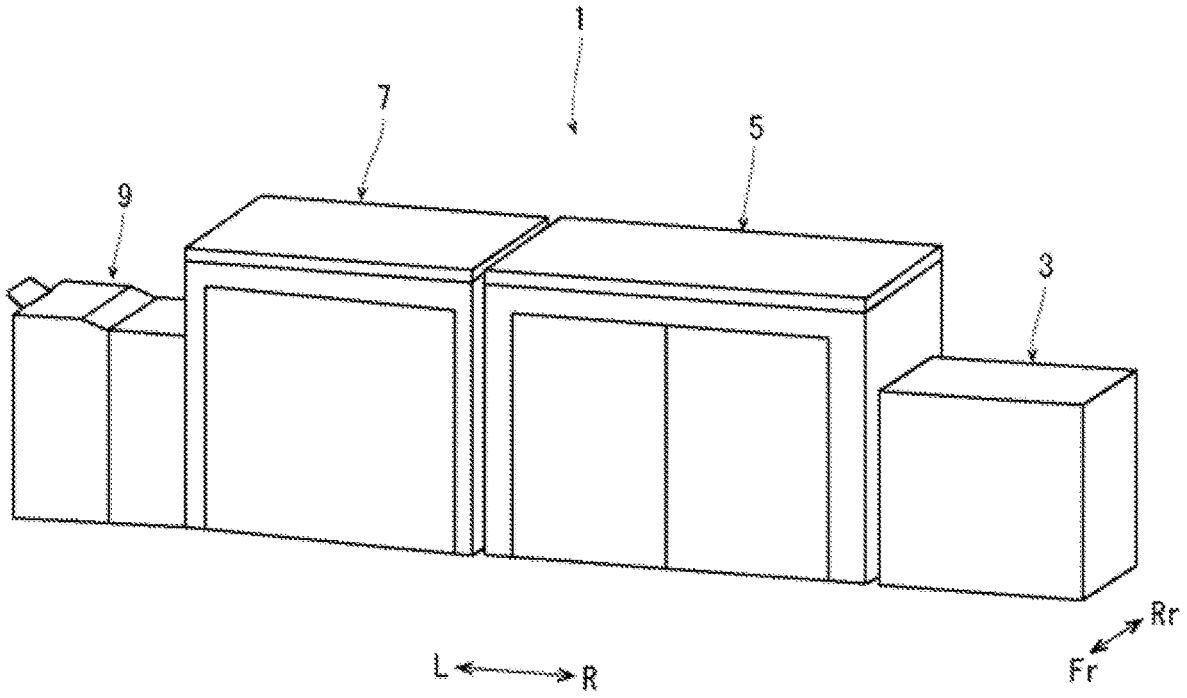
FIG. 1 is a perspective view schematically showing an image forming system according to an embodiment of the present disclosure.

First, an image forming system including a drying apparatus will be described with reference to FIG. 1. FIG. 1 is a front view showing an image forming system. L, R, Fr, and Rr appropriately appended to each of the figures indicate left, right, front, and rear sides of the image forming system, respectively.

The image forming system 1 includes a paper feeder 3, an image forming apparatus 5, a drying apparatus 7, and a post-processing apparatus 9. The paper feeder 3 stores the paper and feeds the paper to the image forming apparatus 5. The image forming apparatus 5 is arranged on the left side of the paper feeder 3, and forms an image on the paper fed from the paper feeder 3 by an ink jet system. The drying apparatus 7 is arranged on the left side of the image forming apparatus 5, and dries the paper on which the image is formed while carrying the paper. The post-processing apparatus 9 is arranged on the left side of the drying apparatus 7, and performs post-treatment on the paper dried by the drying apparatus 7. Paper is an example of a recording medium.

Figure 2:
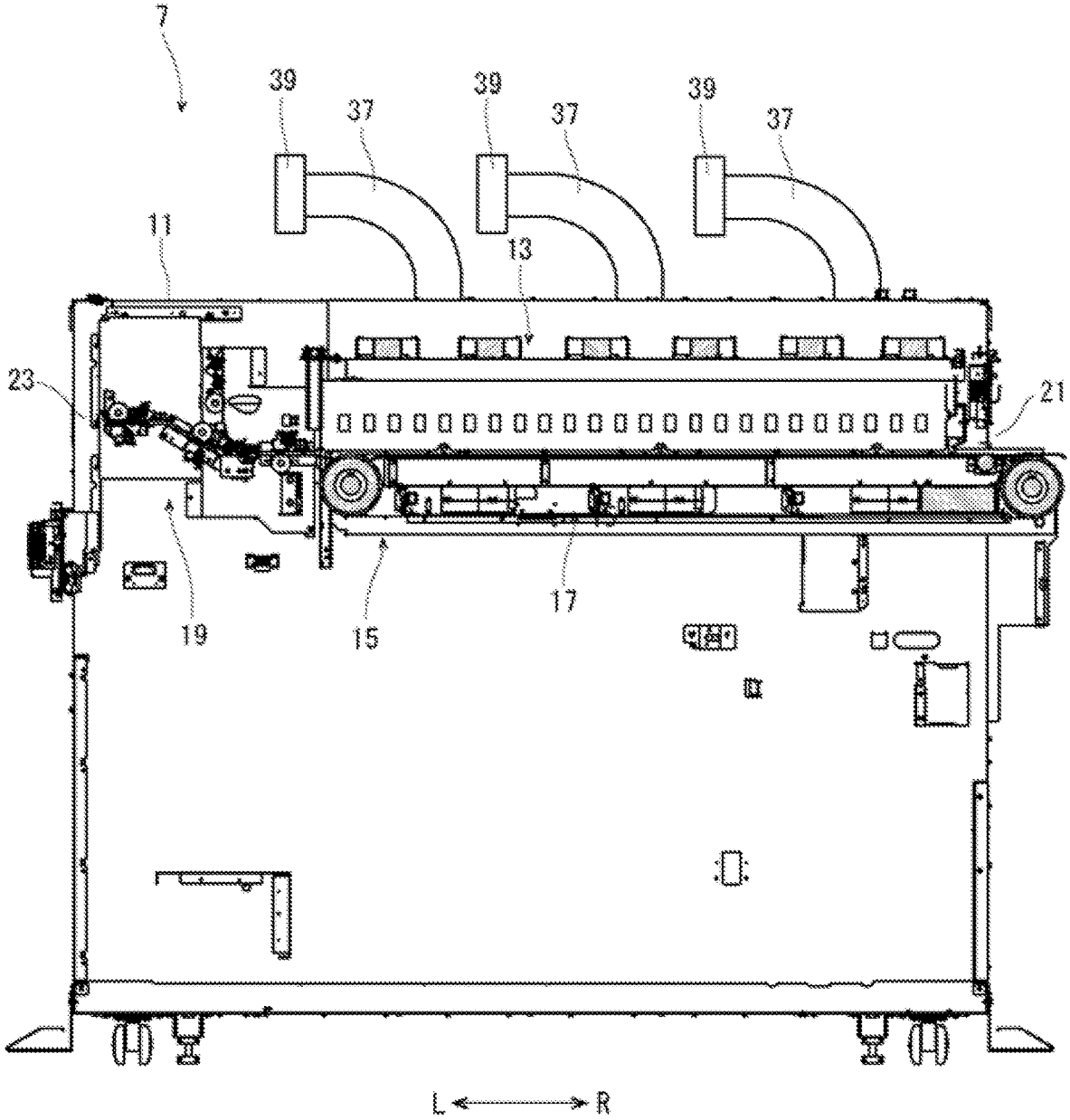
FIG. 2 is a front view showing the inside of a drying apparatus according to the embodiment of the present disclosure.
Figure 3:
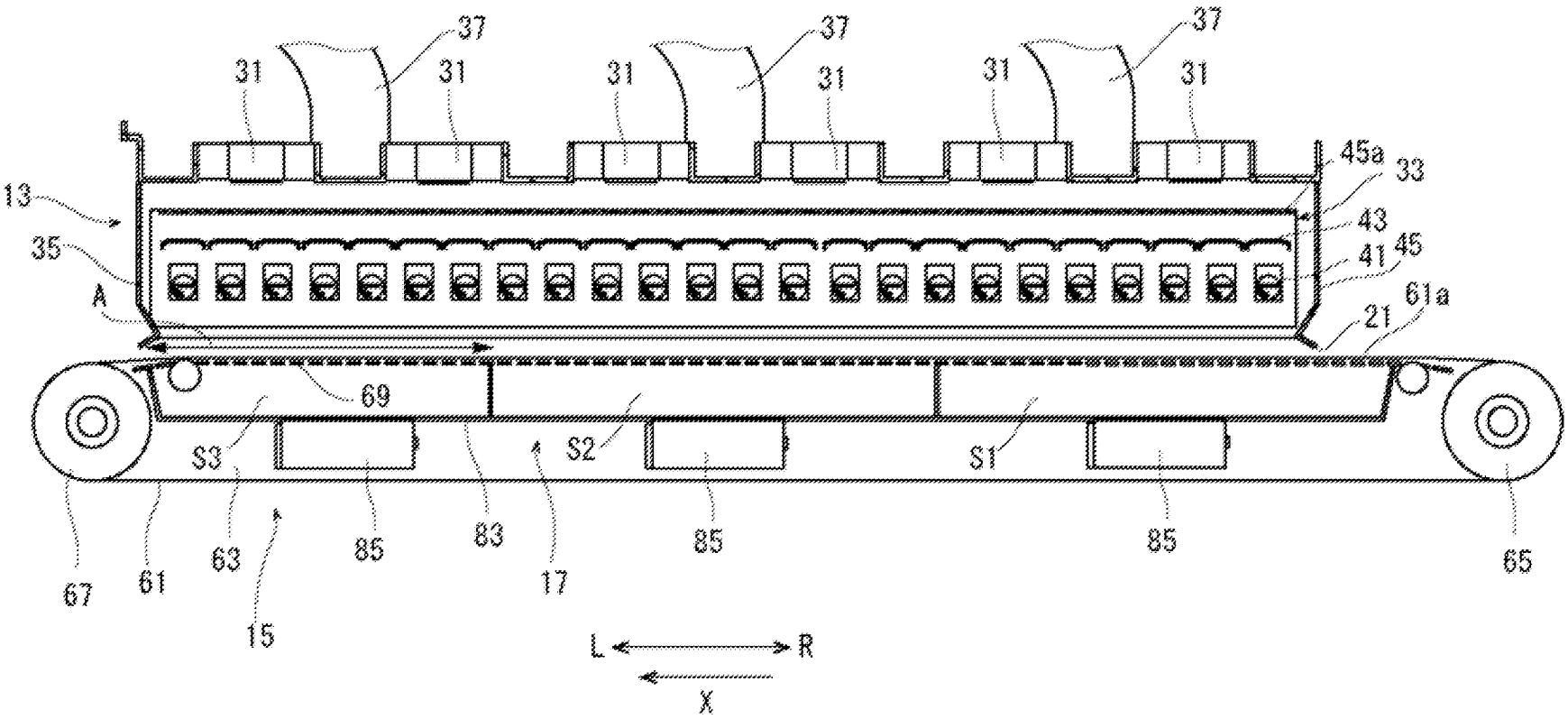
FIG. 3 is a front view showing a heating unit, a conveying unit, and a suction unit of the drying apparatus according to the embodiment of the present disclosure.
Figure 4:
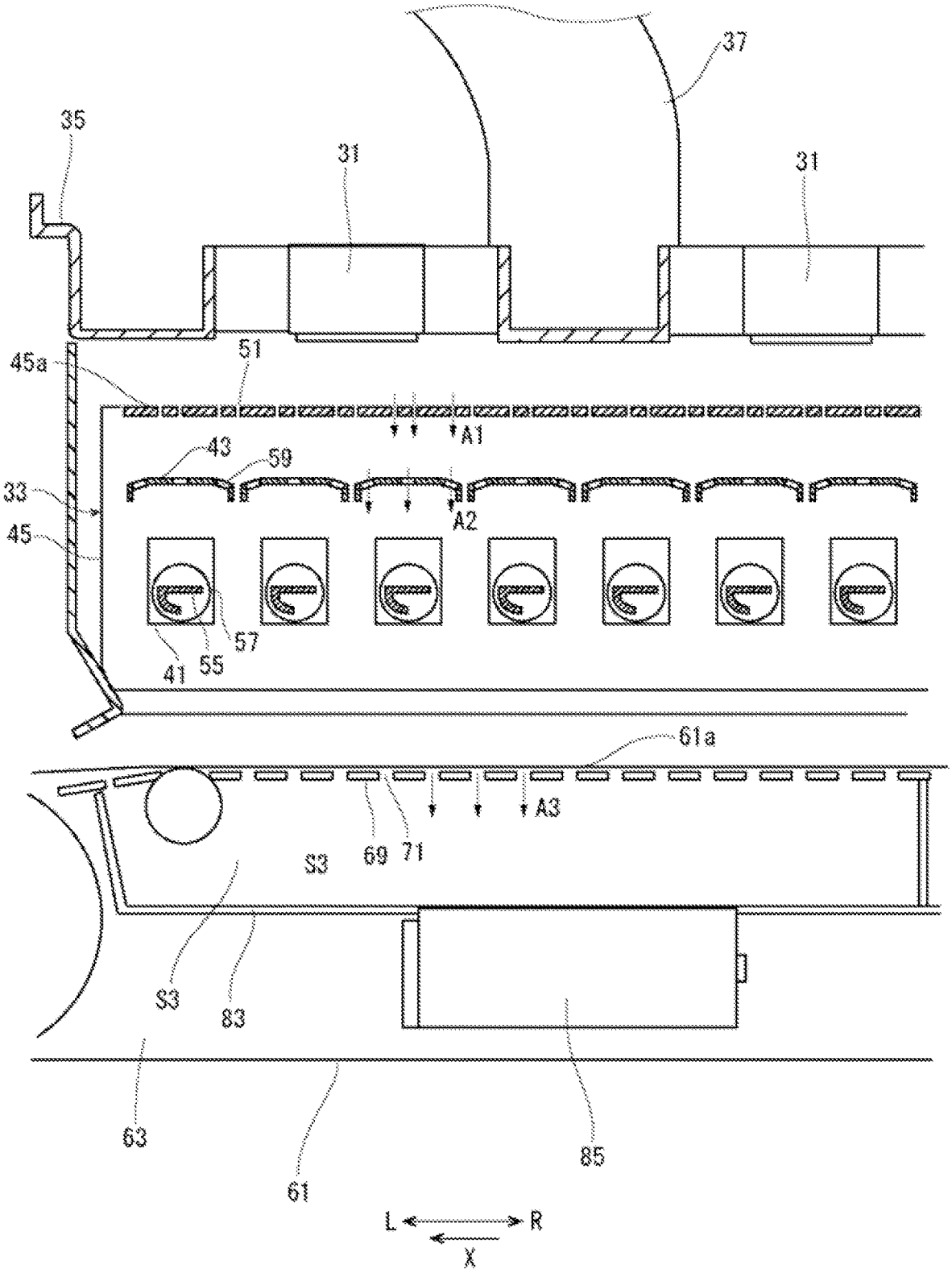
FIG. 4 is an enlarged front view showing a part of a heating unit, a conveying unit, and a suction unit of the drying apparatus according to the embodiment of the present disclosure.
Figure 5:
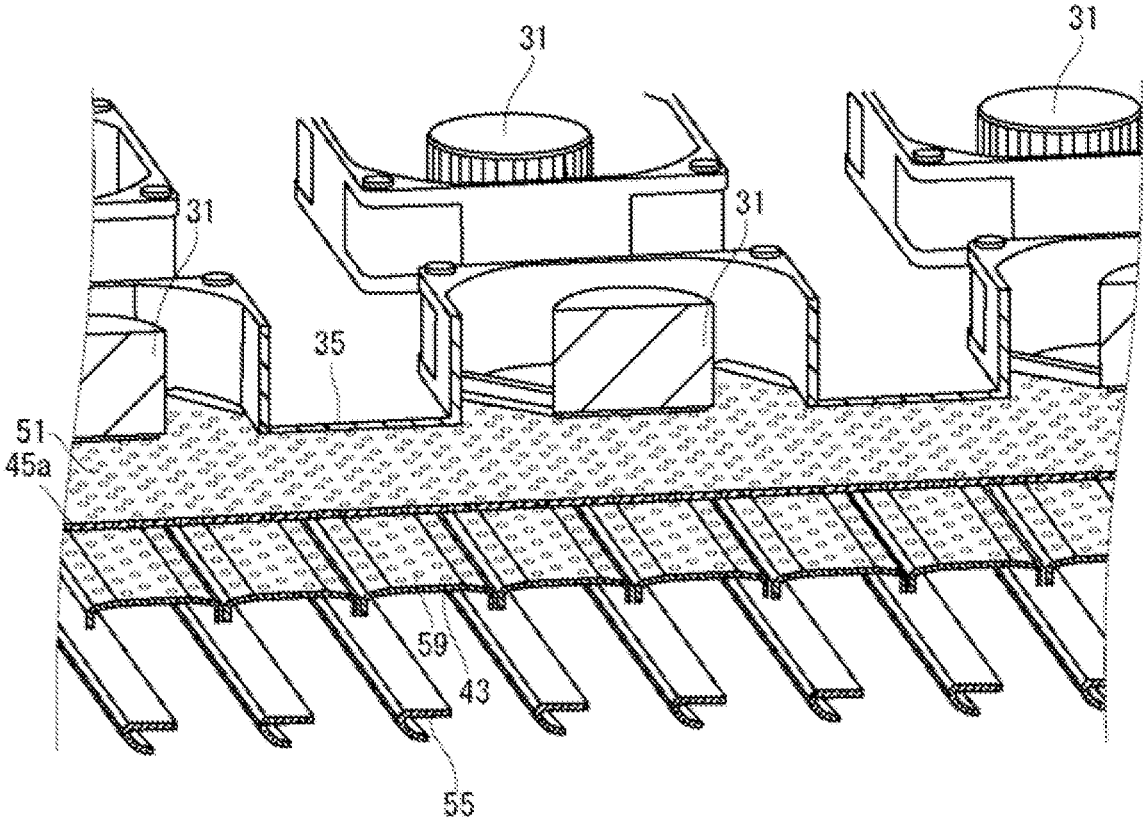
FIG. 5 is an enlarged perspective view showing a part of the heating unit, the conveying unit, and the suction unit of the drying apparatus according to the embodiment of the present disclosure.

Next, the drying apparatus 7 will be described with reference to FIGS. 2 to 5. FIG. 2 is a front view showing the inside of the drying apparatus, FIGS. 3 and 4 are front views showing a heating unit, a conveying unit, and a suction unit, and FIG. 5 is a perspective view showing a heating unit, a conveying unit, and a suction unit.

As shown in FIG. 2, the drying apparatus 7 includes a box-shaped casing 11. The casing 11 includes a rectangular parallelepiped hollow portion surrounded by a top plate, a bottom plate, front and rear side plates, and right and left side plates. A heating unit 13, a conveying unit 15 and a suction unit 17 are housed in the hollow portion on the side (right side) of the image forming apparatus 5. A cooling unit 19 is accommodated in the hollow portion of the casing 11 above the side (left side) of the post-processing apparatus 9.

A receiving portion 21 for receiving paper (medium) from the image forming apparatus 5 is formed on an upper portion of a right side plate (side plate on the side of the image forming apparatus 5) of the casing 11. A discharge portion 23 for delivering the paper to the post-processing apparatus 9 is formed on the left side plate (side plate on the side of the post-processing apparatus 9). The paper is conveyed by the conveying unit 15 and the cooling unit 19 along the conveying direction X from the receiving portion 21 to the discharge portion 23. In the following description, the upstream side and the downstream side respectively indicate the upstream side and the downstream side in the paper conveying direction X. A direction orthogonal to the conveying direction X is defined as a width direction.

Next, the heating unit 13 will be described. As shown in FIGS. 3 and 4, the heating unit 13 includes a plurality of blower fans 31, a heater unit 33, and a case 35 in which the plurality of blower fans 31 are supported and the heater unit 33 is housed.

The case 35 is formed in a box shape with an open lower side, and includes a hollow portion which is long in the conveying direction surrounded by an upper plate, front and rear side plates, and right and left side plates. A plurality of exhaust portions (not shown) (6 exhaust portions in this example) are formed on the upper plate. An exhaust fan 39 (see FIG. 2) is connected to each exhaust portion through a duct 37. By driving each exhaust fan 39, air in the case 35 is exhausted and the air in the hollow portion of the case 35 is circulated.

A plurality of blower fans 31 (12 blower fans in this example) are supported on the upper plate of the case 35. The plurality of blower fans 31 are so arranged that six fans are arranged in each of two rows along the conveying direction X. The distance between the blower fans 31 adjacent to each other in the conveying direction X and the width direction is substantially equal. The plurality of blower fans 31 have the same air volume, take in outside air, and blow the taken outside air to the hollow portion of the case 35.

The heater unit 33 includes a plurality (24 heater units in this example) of infrared heaters 41, a plurality (24 heater units in this example) of reflecting plates 43, and a housing 45 in which the plurality of heaters 41 and the reflecting plates 43 are housed.

The housing 45 is formed in a box shape with an open lower side, and includes a hollow portion which is long in the conveying direction surrounded by the top plate 45*a*, front and rear side plates, and right and left side plates. As shown in FIG. 5, the top plate 45*a* includes a number of first through holes 51 formed in one surface. The plurality of first through holes 51 are arranged in a zigzag shape. The top plate 45*a* is an example of a rectifying member in which a large number of first through holes are formed, and rectifies the air taken into the case 35 by the blower fan 31 so as to be directed downward.

As shown in FIG. 4, each heater 41 includes, for example, a thin plate-like carbon filament 55 and a glass tube 57 in which the filament 55 is housed. Filament 55 radiates infrared rays in all radial directions)(360°). The heaters 41 are arranged at equal intervals along the conveying direction X in an attitude along the width direction.

The reflecting plate 43 has a U-shape opening downward as viewed from the width direction, and includes a substantially rectangular upper wall and a sidewall bent downward at a substantially right angle from both long sides of the upper wall. A large number of second through holes 59 are formed in the upper wall. As shown in FIG. 5, the plurality of second through holes 59 are arranged in a zigzag shape with equal density. In this example, two second through holes 59 and three second through holes 59 are alternately arranged along the width direction. The reflecting plate 43 is disposed above the heater 41 and reflects downward the infrared rays radiated from the filament 55.

Figure 6A:
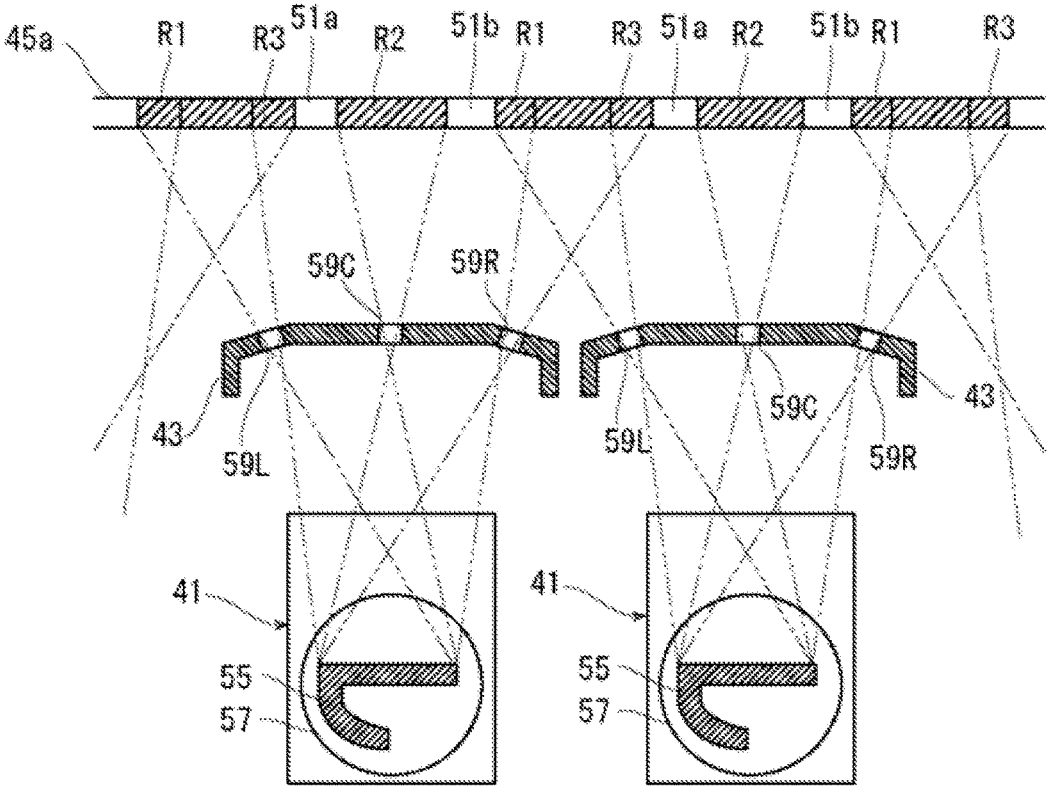
FIG. 6A is a cross-sectional view showing the positional relationship between the through hole of a top plate and the through hole of the reflecting plate in the drying apparatus according to one embodiment of the present disclosure.
Figure 6B:
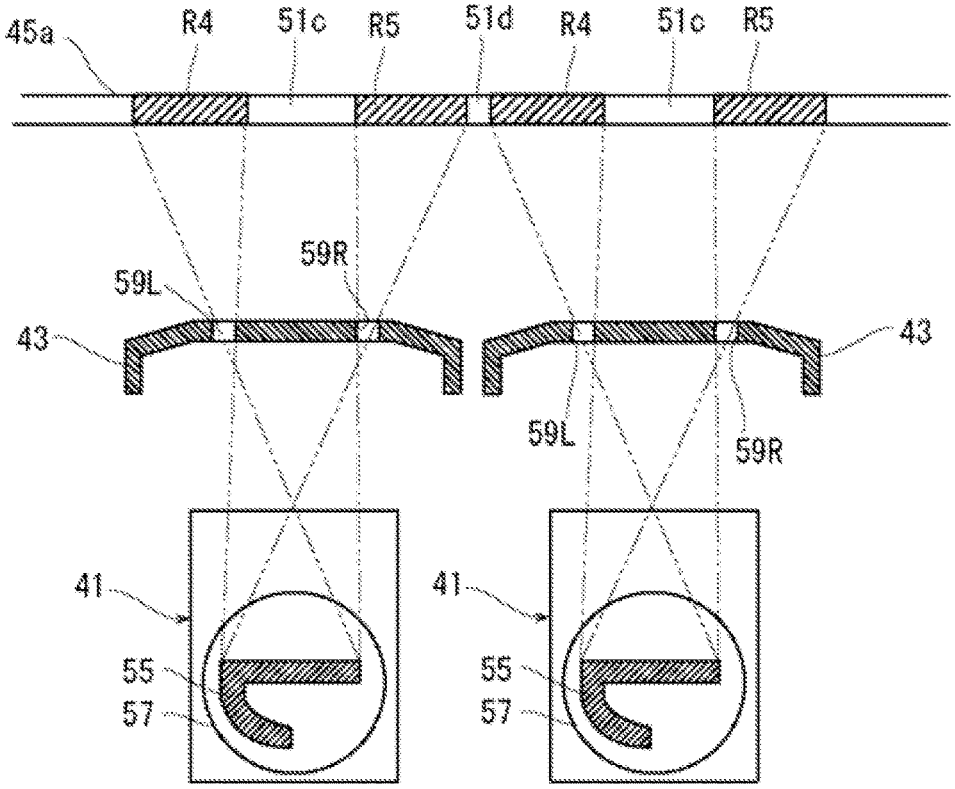
FIG. 6B is a sectional view illustrating the positional relationship between the through hole of the top plate and the through hole of the reflecting plate in the drying apparatus according to another embodiment of the present disclosure.
Figure 7:
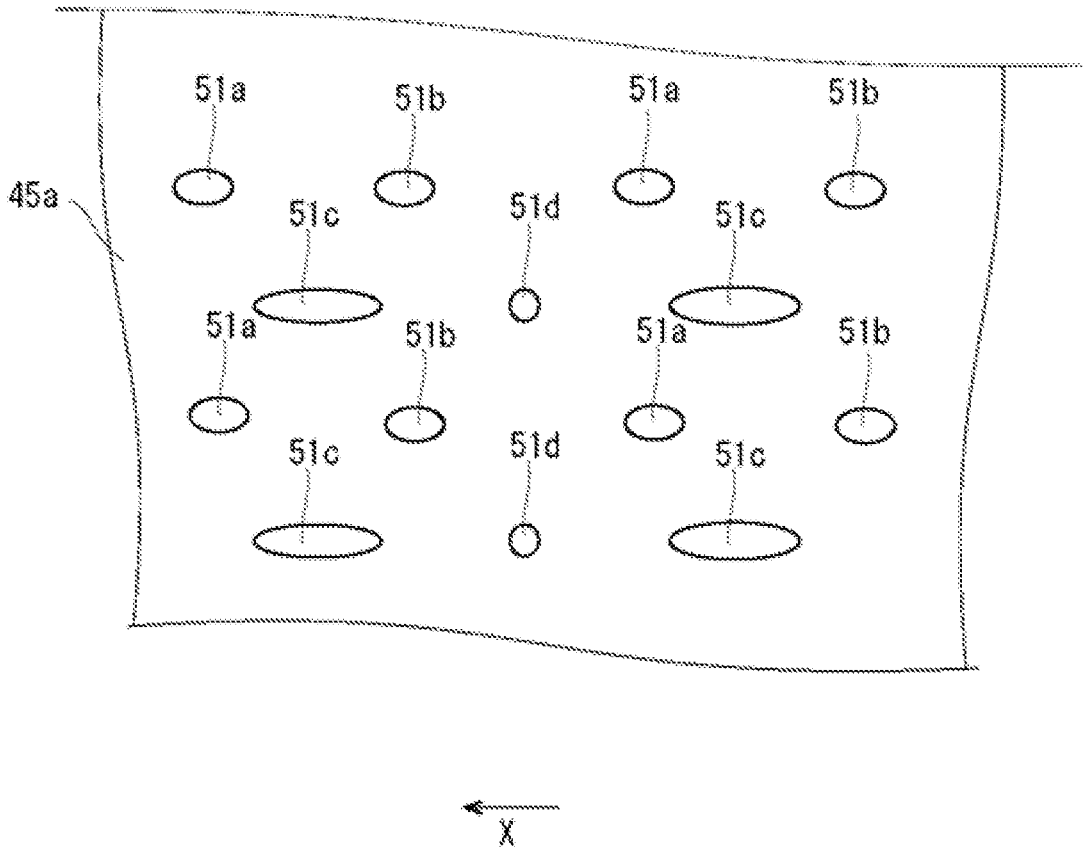
FIG. 7 is a plan view showing an example of the top plate of the drying apparatus according to an embodiment of the present disclosure.

Next, the positional relationship between the first through hole 51 of the top plate 45*a* and the second through hole 59 of the reflecting plate 43 will be described with reference to FIGS. 6A, 6B, and 7. FIGS. 6A and 6B are cross-sectional views showing the positions of the first through hole 51 of the top plate 45*a* and the second through hole 59 of the reflecting plate 43. FIG. 6A shows three second through holes of the reflecting plate 43, and FIG. 6B shows two second through holes of the reflecting plate 43. FIG. 7 is a plan view showing a top plate.

As described above, the heater 41 radiates infrared rays in all directions)(360°) in the radial direction. Infrared rays radiated upward from the heater 41 are reflected downward by the reflecting plate 43. However, since the second through hole 59 is formed in the reflecting plate 43, the infrared rays which have passed via the second through hole 59 among the infrared rays radiated upward are radiated upward, that is, toward the top plate 45*a* and the blower fan 31.

As described above, a number of first through holes 51 are formed in the top plate 45*a*. The first through hole 51 is formed in a portion other than a radiation surface from which the infrared rays are radiated to the top plate 45*a* via the second through hole 59 of the reflecting plate 43.

Specifically, as shown in FIG. 6A, in the case of three second through holes 59, the infrared rays passing via the second through holes 59L on the left side are radiated to the region R1 between the two dot-chain lines, the infrared rays passing via the second through holes 59C in the center are radiated to the region R2 between the two dot-chain lines, and the infrared rays passing via the second through holes 59R on the right side are radiated to the region R3 between the two dotted lines. In this example, the radiation region R1 and the radiation region R3 of the adjacent heaters 41 intersect on the top plate 45*a*.

In the case of two second through holes 59, as shown in FIG. 6B, the infrared ray passing via the second through hole 59L on the left side is radiated to the region R4 between the two double-dotted lines, and the infrared ray passing via the second through hole 59R on the right side is radiated to the region R5 between the two dotted lines.

As shown in FIG. 7, the top plate 45*a* includes a first through hole 51 formed in a portion other than the infrared radiation regions R1, R2, R3, R4, and R5. More specifically, as shown in FIG. 6A, a first through hole 51*a* is formed between the radiation region R3 and the radiation region R2, and a first through hole 51*b* is formed between the radiation region R2 and the radiation region R1. As shown in FIG. 6B, a first through hole 51*c* is formed between the radiation region R4 and the radiation region R5, and a first through hole 51*d* is formed between the radiation region R5 and the radiation region R4.

Next, the conveying unit 15 will be described. As shown in FIGS. 3 and 4, the conveying unit 15 includes a conveying belt 61 and a frame 63 for supporting the conveying belt 61. The frame 63 includes front and rear side plates which are long in the conveying direction X, which are arranged at predetermined intervals in the front and rear directions. A drive roller 65 is rotatably supported between the upstream end units of the front and rear side plates, and a driven roller 67 is rotatably supported between the downstream end portions.

The conveying belt 61 is an endless belt, and a large number of through holes (not shown) are formed on the entire surface. The conveying belt 61 is wound around the drive roller 65 and the driven roller 67. When the drive roller 65 is driven, the conveying belt 61 circulates in the counterclockwise direction in FIGS. 2 to 4. The outer surface of the conveying belt 61 along the upper track (in the direction from the upstream side to the downstream side) serves as the conveying surface 61*a* on which the paper is conveyed. A conveying belt 61 traveling on an upper track is supported by conveying plates 69 supported by front and rear side plates. A through hole 71 (see FIG. 4) is formed on the entire surface of the conveying plate 69. When the conveying belt 61 travels, the back surface of the conveying belt 61 (the back surface of the conveying surface 61*a*) traveling on the upper track slides along the conveying plate 69.

As shown in FIGS. 2 and 3, the conveying unit 15 is formed longer on the upstream side in the conveying direction X than the heating unit 13 is. More specifically, the upstream end of the conveying surface 61*a* of the conveying belt 61 extends upstream from the upstream end of the heating unit 13 and upstream from the receiving portion 21. The downstream end of the conveying surface 61*a* is located at substantially the same position as the downstream end of the heating unit 13 and communicates with the cooling unit 19.

Next, the suction unit 17 will be described. As shown in FIGS. 3 and 4, the suction unit 17 is provided in the hollow portion of the conveying belt 61. The suction unit 17 includes a partition plate 83 and a plurality of (3 suction fans in this example) suction fans 85 supported by the partition plate 83. The partition plate 83 includes a bottom plate and partition walls surrounding four sides, and as shown in FIG. 3, the hollow portion is divided into a plurality of (3 sections in this example) sections S1, S2, S3 along the conveying direction X. The upper surface of each section is opened to face the conveying plate 69.

The suction fan 85 is attached to the bottom plate of the partition plate 83 corresponding to each section. The plurality of suction fans 85 have the same air volume. When the suction fan 85 is driven, the air in the space above the conveying belt 61 (conveying surface 61*a*) moving on the upper track is taken into each section via the through hole of the conveying belt 61 and the through hole 71 of the conveying plate 69.

An example of the drying operation of the drying apparatus 7 having the above configuration will be described with reference to FIGS. 2 to 5. The paper on which the image is formed by the image forming apparatus 5 (see FIG. 1) is received by the conveying unit 15 through the receiving portion 21 of the drying apparatus 7. As described above, since the upstream end of the conveying surface 61*a* of the conveying belt 61 extends to the upstream side of the receiving portion 21, the paper discharged from the image forming apparatus 5 is placed on the conveying surface 61*a* of the conveying belt 61.

In the conveying unit 15, the drive roller 65 is driven to rotate, and the conveying belt 61 travels. Thus, the paper placed on the conveying surface 61*a* is conveyed into the casing 11 through the receiving portion 21.

Further, the blower fan 31 of the heating unit 13 and the heater unit 33 are driven. The air taken into the hollow portion of the case 35 by the intake fan 31 is blown downward. The air enters the housing 45 through the first through hole 51 formed in the top plate 45*a* of the housing 45 of the heater unit 33 (see arrow A1 in FIG. 4). In the housing 45, the infrared rays are radiated from each heater 41 in all directions by driving the heater unit 33. The infrared rays radiated upward from the heater 41 are reflected downward by the reflecting plate 43.

Here, the first through hole 51 (51*a*, 51*b*, 51*c*, and 51*d* in FIGS. 6A, 6B, and 7) is formed in a portion of the reflecting plate 43 other than the region where the infrared rays passing via the second through hole 59 are radiated to the top plate 45*a*. Therefore, the infrared rays radiated upward from the heater 41 via the second through hole 59 of the reflecting plate 43 are blocked by the top plate 45*a*.

The air entering the housing 45 is blown further downward via the second through hole 59 of the reflecting plate 43 of the heater unit 33 (see arrow A2 in FIG. 4) and heated by the infrared rays radiated from the heater 41. The air thus heated is blown onto the paper conveyed along the conveying surface 61*a* of the conveying belt 61 to dry the ink. Further, the paper is pressed against the conveying surface 61*a* by the blown air.

Further, the suction fan 85 of the suction unit 17 is driven. As a result, as described above, the air in the space above the conveying belt 61 moving on the upper track is taken in through the respective sections through the through holes of the conveying belt 61 and the through holes 71 of the conveying plate 69 (see arrow A3 in FIG. 4), and the pressure above the conveying surface 61*a* becomes negative. Then, the paper conveyed on the conveying surface 61*a* of the conveying belt 61 is attracted to the conveying surface 61*a*.

When the paper is conveyed along the conveying surface 61*a* from the upstream side to the downstream side, the ink is dried by the heating unit 13.

While the paper is conveyed on the conveying surface 61*a*, the inside of the case 35 of the heating unit 13 and the inside of the housing 45 of the heater unit 33 become an environment of high humidity and high temperature, so that the exhaust fan 39 (see FIG. 1) is driven to circulate the air.

The paper conveyed along the conveying surface 61*a* to the downstream side is conveyed to the cooling unit 19 (see FIG. 1), cooled by the cooling unit 19, and conveyed to the post-processing apparatus 9 (see FIG. 1) through the discharge portion 23.

As is clear from the above description, according to the drying apparatus 7 of the present disclosure, the first through hole 51 (51*a*, 51*b*, 51*c*, and 51*d* in FIGS. 6A, 6B, and 7) is formed in a portion other than the region where the infrared rays passing via the second through hole 59 of the reflecting plate 43 are radiated to the top plate 45*a*, among the infrared rays radiated upward from the heater 41. That is, since the infrared rays radiated upward from the heater 41 via the second through hole 59 of the reflecting plate 43 are blocked by the top plate 45*a*, the amount of the infrared rays radiated upward toward the blower fan 41 through the first through hole 51 of the top plate 45*a* can be reduced. Therefore, damage to the blower fan 41 due to heating can be suppressed.

Since the first through hole 51 is formed in the top plate 45*a* in a region other than the infrared radiation region where the infrared rays passing via the second through hole 59 of the reflecting plate 43 are radiated, the air volume for drying the medium can be secured.

According to the present disclosure, since the infrared ray radiated upward from the heater via the second through hole of the reflecting plate is blocked by the rectifying member, the amount of the infrared ray radiated upward toward the blower fan can be reduced. Therefore, damage to the blower fan due to heating can be suppressed.

Although the present disclosure has been described for specific embodiments, the present disclosure is not limited to the above embodiments. Without departing from the scope and spirit of the present disclosure, the foregoing embodiments may be variously modified, substituted, or modified, and the claims include all embodiments that may be included within the scope of the technical idea.

What is claimed is:

1. A drying apparatus for drying a medium on which an image has been formed while conveying the medium, the drying apparatus comprising:

a conveying belt that supports the medium and conveys the medium in a predetermined conveying direction; and a heating unit that dries the image by blowing hot air onto the medium, the heating unit including:

a blower fan that takes in outside air and blows air toward the conveying belt;

a rectifying member that is arranged on a downstream side of the blower fan in a blowing direction of the blower fan and includes one or more first through holes;

a heater that is arranged on a downstream side of the rectifying member in the blowing direction and radiates infrared rays in all directions; and a reflecting plate that is arranged between the rectifying member and the heater, includes one or more second through holes, and reflects the infrared rays radiated from the heater toward the conveying belt, wherein the one or more first through holes in the rectifying member are formed in a portion other than a portion where the infrared rays passing through the one or more second through holes of the reflecting plate are radiated among the infrared rays radiated from the heater.

2. An image forming system comprising:

an image forming apparatus that forms an image on a medium; and a drying apparatus that dries the medium on which the image has been formed by the image forming apparatus while conveying the medium;

the drying apparatus including:

a conveying belt that supports the medium and conveys the medium in a predetermined conveying direction; and a heating unit that dries the image by blowing hot air onto the medium, the heating unit including:

a blower fan that takes in outside air and blows air toward the conveying belt;

a rectifying member that is arranged on a downstream side of the blower fan in a blowing direction of the blower fan and includes one or more first through holes;

a heater that is arranged on a downstream side of the rectifying member in the blowing direction and radiates infrared rays in all directions; and a reflecting plate that is arranged between the rectifying member and the heater, includes one or more second through holes, and reflects the infrared rays radiated from the heater toward the conveying belt, wherein the one or more first through holes in the rectifying member are formed in a portion other than a portion where the infrared rays passing through the one or more second through holes of the reflecting plate are radiated among the infrared rays radiated from the heater.

* * * * *